US005950761A

United States Patent [19]

Murphy

[11] Patent Number: 5,950,761

[45] Date of Patent: Sep. 14, 1999

[54] END CAP FOR STRUCTURAL MEMBER AND METHOD

[75] Inventor: Barbara J. Murphy, Clark County, Ind.

[73] Assignee: Emerson Electric Company, St. Louis, Mo.

[21] Appl. No.: 09/145,509

[22] Filed: Sep. 2, 1998

[51] Int. Cl.[6] ..... E06C 7/48

[52] U.S. Cl. ..... 182/108; 182/129

[58] Field of Search ..... 182/108, 129; 16/110 R

[56] References Cited

U.S. PATENT DOCUMENTS 311,790 2/1885 Spangler .
1,477,742 12/1923 Wright .
3,705,674 12/1972 Fisher .
4,870,757 10/1989 Kirkpatrick .
4,888,846 12/1989 Natale .
5,533,591 7/1996 Kiska ..... 182/108
5,758,745 6/1998 Beggs et al. ..... 182/207
5,845,364 12/1998 Chen .

*Primary Examiner*—Alvin Chin-Shue
*Attorney, Agent, or Firm*—Polster, Lieder, Woodruff & Lucchesi, LC

[57] ABSTRACT

A structural member end cap and method, the end cap having a gripping portion and a recessed socket portion sized to snuggly engage a structural member, the end cap including integral engaging means to permit key and key-way engagement to restrict radial movement of assembled parts and fastening means to restrict longitudinal movement of assembled parts.

21 Claims, 1 Drawing Sheet

END CAP FOR STRUCTURAL MEMBER AND METHOD

BACKGROUND OF THE INVENTION

The present invention related to structural assemblies and more particularly to an end cap arrangement for a structural member, such as a ladder rail or platform, and a method of manufacturing an end cap and assembling an end cap to a structural member.

End caps for structural members are generally well known in the structural arts and more particularly in the ladder and platform industry art, attention being directed to U.S. Pat. No. 5,533,591, issued to S. A. Kiska on Jul. 9, 1996; and U.S. Pat. No. 5,758,745, issued Jun. 2, 1998 to R. D. Beggs et al. Both of these patents teach end cap structure specifically useful in the ladder assembly art, the end caps disclosed in these patents being comparatively complex in manufacture and mating assembly, often requiring additional parts to maintain assembled relationship. The present invention, recognizing the limitations of prior art end caps, avoids the complexity of prior art end caps and their assembly providing a unique and novel end cap and structural member assembly which is straightforward and economical in both manufacture and assembly and yet restricting relative movement both circumferentially or radially and longitudinally between the assembled parts. Further, the unique method and structural arrangement disclosed herein can be employed generally to many other structural arts enhancing lifting and transportation of structural parts and forming barriers for undesirable sharp structural edges. Various other features of the present invention will become obvious to one skilled in the art upon reading the novel disclosure set forth herein.

BRIEF SUMMARY OF THE INVENTION

More particularly the present invention provides a novel end cap for a structural member comprising: an end cap including recessed socket and gripping portions in the end cap, the socket portion being sized to engage and snuggly surround at least a portion of a structural member, the end cap recessed socket portion including at least one integral engaging means to permit a key and keyway engagement between a structural member restricting radial or circumferential movement of the end cap relative the structural member. Further, the present invention provides a novel method of protecting and lifting a support beam structural unit that includes a longitudinally extending base section and at least one longitudinally extending keying flange integral with and extending form the base section comprising: forming an end cap for the structural unit sized to snuggly engage at least a portion of the structural unit and configured to include a nesting flange snuggly cooperative with the keying flange on the structural unit so that one nesting keying flange serves as a key and the other as an interfitting keyway; and fastening the end cap to the structural unit in surrounding relationship with the extremity thereof with the keying flanges in nesting engagement, restricting relative longitudinal movement.

It is to be understood that various changes can be made by one skilled in the art in one or more of the several parts and the several steps disclosed herein without departing from the scope or spirit of the present invention.

BRIEF DESCRIPTION OF THE DRAWINGS

Referring to the drawings which disclose one advantageous embodiment of the present invention.

DETAILED DESCRIPTION OF THE INVENTION

Figure 1:
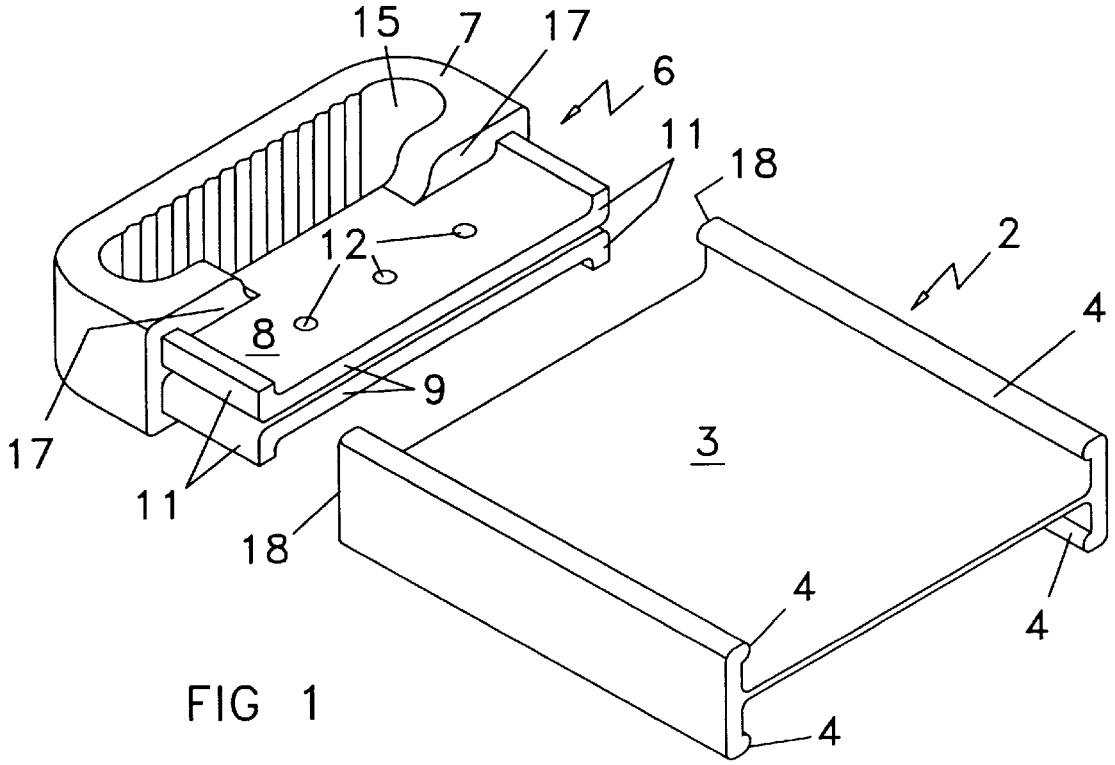
FIG. 1 is an exploded, isometric, partial view of the inventive end cap and structural beam arrangement.

Referring to the drawings, the end extremity of an "I"-beam 2 in the form of a support rail for a ladder or platform is disclosed. It is to be understood that the present invention is not to be considered as limited to the particular structural part disclosed but that the invention can be employed with other structural parts in other structural environments. The "I"-beam 2, as disclosed herein, includes a longitudinally extending base 3 having mirror-image pairs of spaced integral flanges 4 extending from opposite faces of base 3 along the side edges thereof. These mirror-image flanges 4 of each pair are inwardly turned toward each other to provide spaced longitudinally extending keyways on opposite face edges of base 3. In this regard, and as above discussed, the present invention is not to be considered as limited to the particular I-beam structure disclosed but that other structural members, such as one having an "L"-beam shaped flange forming a keyway along one face could also be employed with the present invention. The structural member 2 can be formed from any one of a number of materials, including but not limited to steel, aluminum, plastic or fiberglass.

An end cap 6 is shown in FIG. 1 of the drawings in alignment for assembly with the extremity of structural I-beam member 2. Like structural member 2, it too can be formed from any one of several materials and advantageously is formed from a suitably molded plastic. The disclosed end cap 6 includes a gripping portion, and a bifurcated distal recessed socket portion 8. Socket portion 8 includes a pair of spaced parallel distal flanges 9 extending from gripping portion 7 of end cap 6. Distal flanges 9 are sized to snuggly and nestingly engage opposed faces of the extremity of base 4 of I-beam 2. The pairs of spaced flanges are each provided with pairs of spaced mirror-image keys in the form of longitudinally extending keys 11 which are integral with and extend from the outer edge faces of each of distal flanges 9, the keys being sized, positioned and configured to nestingly engage and interfit with the pairs of longitudinally extending spaced, mirror-image keyways 4 extending from the base 3 of I-beam 2.

Figure 2:
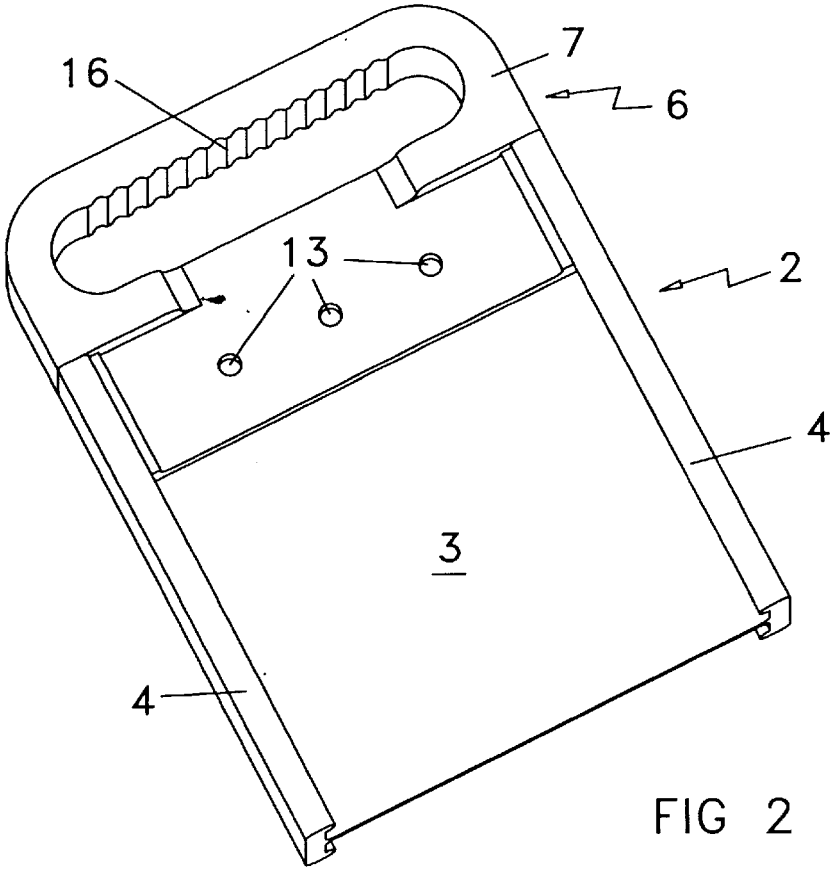
FIG. 2 is an isometric partial view of the assembled structure of FIG. 1.

As can be seen in the drawings, each of distal flanges 9 is provided with a set of aligned, spaced, rivet receiving apertures 12 which extend between the pair of spaced, longitudinally extending keys 11 so as to receive rivet sets 13 (FIG. 2) for fastening the distal flanges 9 to the base 3 of I-beam 2.

As can be seen in the drawings, the gripping portion 7 of end cap 6 includes a finger gripping aperture disposed therein with the peripheral wall defining aperture being serrated as at 16 to enhance manual gripping. If is to be noted that gripping portion 7 is provided with opposed end faces 17 adjacent manual accommodating gripping aperture 16. These end faces 17 are adapted to abut against the end faces 18 of the keyways 4 of I-beam 2 when the flanges 9 of distal recessed socket portion 8 engages opposed faces of the base 3 of the extremity of I-beam 2.

In the novel and inventive method of protecting and lifting a support beam structural unit that includes a longitudinally extending base section and at least one longitudinally extending keying flange integral with and extending from the base section, and end cap, such as end cap 6 is formed to snuggly engage at least a portion of such structural unit. The formed end cap and formed structural member can be so configured that one includes a nesting flange which serves as a key and the other includes a keying flange serving as a keyway. The end cap can then be fastened to the structural unit to be in surrounding relation with the extremity thereof with the key and keyway flanges in nesting engagement. In addition, a serrated gripping portion can be formed on the end cap and the end cap, when assembled on the structural unit, can be firmly fastened thereto by suitable rivets. Thus, an end cap is provided which can be fastly connected with both restricted radial and longitudinal movement.

The invention claimed is:

1. In combination with a structural member and an end cap therefore, a structural assembly arrangement comprising: said structural member engaging said end cap and including a pair of planar longitudinally and cantilevering spaced flange members, each spaced flange member having one end fastened to and transversely extending across said end cap and a longitudinally extending distal portion, the flange members having longitudinally extending keys which with said flange members define a pair of recessed transversely extending socket portions sized to engage with and snugly surround in sandwiched relation at least a transversely extending planar portion of said structural member; the structural member planar portion having keyway means cooperating with said keys to restrict circumferential movement of said end cap relative said structural member.

2. The structural assembly arrangement of claim 1, and fastening means to restrict longitudinal movement of the end cap relative said portion of said structural member.

3. The structural assembly of claim 1, wherein said spaced flanges of said end cap when snuggly engaged along opposed faces of the base of said structural member include a spaced set of fastening rivets to restrict longitudinal movement of said end cap relative said structural member.

4. The structural assembly of claim 1, said end cap including a manual gripping portion extending from the recessed socket portion to enhance manual assembly of said end cap to said structural member.

5. The structural assembly of claim 4, said gripping portion having a finger receiving recess there in sized to accommodate an individual handgrip.

6. The structural assembly of claim 5, peripheral walls of said recess including serrations to minimize hand slippage.

7. In combination with a support beam extremity having a longitudinally extending planar base portion and having longitudinally extending keyways integral with said planar base portion: a separate end cap for said support beam extremity, said end cap including an outer gripping portion having an end face configured to facingly abut against the end face of the base of said support beam extremity and a spliced distal recessed socket portion extending from said end face of said outer gripping portion, said spliced distal recessed socket portion including a pair of planar longitudinally and cantilevering spaced flange members each spaced flange member having one end fastened to and transversely extending across said end cap and a longitudinally extending distal portion to provide a pair of spaced distal flanges sized to snugly and nestingly engage and sandwich opposed faces of said planar base portion of said support beam, the distal flanges of the distal recessed socket portions having longitudinally extending keys, wherein the recessed socket portion defines a back to back substantially C-shaped configuration and sized to nest with said keyway integral with said base of said support beam extremity.

8. The support beam extremity and end cap structure of claim 7, wherein the keyways includes at least one pair of spaced, opposed, mirror-image, longitudinally extending keyways integral with the planar base with the keys including a pair of spaced, opposed, mirror-image, longitudinally extending keys sized and positioned to nest with the pair of spaced keyways integral with said planar base of said support beam extremity.

9. The support beam extremity and end cap structure of claim 7, wherein the pair of spaced distal flanges of said distal recessed socket portion includes at least one set of spaced rivet receiving apertures to receive rivets to fasten to said support beam extremity.

10. The support beam extremity and end cap structure of claim 7, wherein the pair of spaced distal flanges of said distal recessed socket portion includes an aligned set of spaced rivet receiving apertures to receive rivets to fasten to said support beam extremity.

11. The support beam extremity and end cap structure of claim 7, said outer gripping portion including a finger receiving aperture therein to accommodate an individual handgrip.

12. The support beam extremity and end cap structure of claim 11, said finger receiving aperture having serrations along periphery thereof to minimize hand slippage.

13. The support beam extremity and end cap structure of claim 7, said end cap being of a molded plastic material.

14. The support beam extremity and end cap structure of claim 7, wherein said support beam extremity has a cross-section in the configuration of the cross-section on an I-beam to include said planar base portion and the keyways include and pairs of spaced, opposed, mirror-image, aligned keyways on opposed side edge faces of said planar base portion and the keys include pairs of spaced, opposed, mirror-image, aligned keys which are sized, positioned and configured to nestingly conform with said pairs of spaced aligned keyways on opposed side edge faces of said planer base portion.

15. In combination with a support rail extremity for a structural support having a cross-section in the form of the cross-section of an I-beam to include a base and pairs of spaced, opposed, mirror-image keyways on opposite face edges of said base, a molded plastic end cap for said end extremity of said support rail, said molded end cap including a gripping portion and a bifurcated distal recessed socket portion including a pair of spaced distal flanges extending from said gripping portion of said end cap, said distal flanges being sized to snuggly and nestingly engage opposed faces of said support rail; pairs of spaced, opposed, mirror-image keys integral with and extending from the outer edge faces of said distal flanges, said keys being sized, positioned and configured to nestingly interfit with said pairs of spaced keyways on opposite edge faces of said base of said support rail extremity; each of said distal flanges having a set of aligned rivet apertures extending between said pairs of spaced keys to receive rivet sets for fastening said spaced distal flanges to said base of said rail extremity; said gripping portion of said molded end cap including a finger gripping aperture disposed therein with the peripheral wall defining said finger gripping; said gripping portion including end faces adapted to abut against the end faces of said support rail extremity when said distal recessed socket portion engages with said rail extremity.

16. A method of protecting and lifting a support beam structural unit that includes a longitudinally extending planar base section and longitudinally extending keying flanges integral with and extending from said planar base section comprising: forming an end cap for said structural unit sized to snugly engage and sandwich at least a portion of said planar base section of said structural unit and configured to include a pair of planar longitudinally and cantilevering spaced flange members, each spaced flange member having one end fastened to and transversely extending across said end cap and a longitudinally extending distal portion, said spaced flange members having longitudinally extending keys defining a back to back substantially C-shaped configuration providing nesting flanges snugly cooperative with said keying flange on said structural unit so the nesting flanges serve as keys and the keying flanges serve as intermitting keyways, and fastening said end cap to said structural unit in surrounding relation with the extremity thereof with the keying flanges in nesting engagement.

17. The method of claim 16, including forming a gripping means in said end cap.

18. An end cap for a structural member comprising: recessed socket and gripping portions in said end cap, said socket portion including a pair of planar longitudinally and cantilevering, spaced flange members, each spaced flange member having one end fastened to and transversely extending across said end cap and a longitudinally extending distal portion being sized to engage and snugly surround at least a planar portion of said structural member, said spaced flange portions having longitudinally extending keys which define a back to back substantially C-shaped configuration to permit a key and keyway engagement between said structural member to restrict radial movement of said end cap relative said structural member.

19. The end cap of claim 18, said socket portion including recessed aperture means to locate and position fastener means to fasten said end cap to said structural member when engaged therewith to restrict longitudinal movement thereof.

20. The end cap of claim 18, said end cap being formed from a moldable plastic material.

21. The end cap of claim 18, said end cap including a gripping portion integral with said socket portion, said gripping portion being conformed for manual handling and including at least one end face contoured to abuttingly engage a face of said structural member.

* * * * *

UNITED STATES PATENT AND TRADEMARK OFFICE

CERTIFICATE OF CORRECTION

PATENT NO : 5,950,761

DATED : September 14, 1999

INVENTOR(S) : Barbara J. Murphy

It is certified that error appears in the above-identified patent and that said Letters Patent is hereby corrected as shown below:

Col. 4, line 32
replace "include and pairs"
with --include pairs--.

Signed and Sealed this

First Day of August, 2000

*Attest:*

Q. TODD DICKINSON

*Attesting Officer*

*Director of Patents and Trademarks*